US005688369A

United States Patent [19]

Landmark et al.

[11] Patent Number: 5,688,369

[45] Date of Patent: Nov. 18, 1997

[54] METHOD AND DEVICE FOR FEEDING OUT FIBRE PULP

[75] Inventors: Lars Landmark, Kil; Mikael Nilsson, Karlstad, both of Sweden

[73] Assignee: Kvaerner Pulping Aktiebolag, Karlstad, Sweden

[21] Appl. No.: 649,610

[22] PCT Filed: Nov. 1, 1994

[86] PCT No.: PCT/SE94/01022

§ 371 Date: May 23, 1996

§ 102(e) Date: May 23, 1996

[87] PCT Pub. No.: WO95/14810

PCT Pub. Date: Jun. 1, 1995

[30] Foreign Application Priority Data

Nov. 29, 1993 [SE] Sweden ..... 9303946

[51] Int. Cl.[6] ..... D21C 9/10; D21C 7/08

[52] U.S. Cl. ..... 162/57; 162/246; 162/60; 162/55; 162/52; 68/181 R; 8/156

[58] Field of Search ..... 162/246, 243, 162/19, 60, 55, 57, 65, 52; 68/158, 181 R; 8/156; 209/10, 170

[56] References Cited

U.S. PATENT DOCUMENTS

| | | | |
|---|---|---|---|
| 3,348,390 | 10/1967 | Richter | 68/181 R |
| 3,524,551 | 8/1970 | Richter | 8/156 X |
| 3,815,386 | 6/1974 | Gullichsen et al. | 68/181 R |
| 3,976,538 | 8/1976 | Gullichsen et al. | 162/17 |
| 4,421,224 | 12/1983 | Laasko | 8/156 |
| 4,529,482 | 7/1985 | Richter et al. | 162/246 |
| 4,556,494 | 12/1985 | Richter et al. | 210/785 |
| 4,793,161 | 12/1988 | Richter et al. | 68/181 R |
| 4,881,286 | 11/1989 | Richter et al. | 8/156 |
| 5,027,620 | 7/1991 | Richter | 68/181 R |
| 5,129,119 | 7/1992 | Sherman | 8/156 |
| 5,271,672 | 12/1993 | Reck | 366/169 |
| 5,300,195 | 4/1994 | Richter et al. | 162/146 |

FOREIGN PATENT DOCUMENTS 0269124 11/1987 European Pat. Off. .

*Primary Examiner*—Donald E. Czaja
*Assistant Examiner*—Jose S. Fortuna
*Attorney, Agent, or Firm*—Fasth Law Firm

[57] ABSTRACT

The invention relates to a method and a device for feeding out fiber pulp over an overflow rim (2) at the upper end of a cylindrical container (1), through which the pulp, which is suspended in liquid, is being fed continuously from the bottom and upwards. The distinguishing features are that the pulp is diluted at a level below the upper surface of the pulp by means of a multiplicity of diluting nozzles (15A–D), which extend downwards in the pulp and which are rotated around the vertical center line (12) of the container, and that the pulp, which has been fed upwards through the container, and the diluting liquid are mixed with each other to form an essentially homogeneous suspension with the aid of rotating scraper elements (14A–D) which extend downwards in the surface layer of the suspension and, at the same time as they are homogenizing the mixture, feed the suspension outwards towards, and finally over, the overflow rim.

17 Claims, 3 Drawing Sheets

METHOD AND DEVICE FOR FEEDING OUT FIBRE PULP

This Application is filed under 35 USC 371 of PCT/SE094/01022 filed Nov. 2, 1994.

TECHNICAL FIELD

The invention concerns the cellulose technique and relates to a method for feeding out fibre pulp over an overflow rim at the upper end of a cylindrical container through which the pulp, which is suspended in a liquid, is being fed continuously from the bottom and upwards. The invention also relates to a device for, at the upper end of the cylindrical container through which the suspended fibre pulp is being fed continuously upwards, feeding out the fibre pulp over the overflow rim and also diluting the pulp to a concentration which is desired for the subsequent treatment.

BACKGROUND TO THE INVENTION

Many processes within the cellulose production technique are carried out using pulp concentrations of the order of size of 10%, so-called MC pulp. This is the case, for example, for a number of bleaching techniques. Whereas this concentration of medium magnitude is very suitable for the bleaching process, it is not appropriate, for example, for subsequent washing stages in the form of washing presses and filters.

In accordance with the current technique, the fibre pulp is fed out, with the aid of scrapers, over an overflow rim at the upper end of the bleaching tower. At this point, the pulp normally has a concentration of from 8 to 10% and is thus far from being of low viscosity. This means that it forms more or less connected lumps when it is driven out by the scrapers into a channel, a so-called launder, outside the overflow rim. In the launder, diluting nozzles are located through which liquid, usually water, is supplied to the pulp in the launder so that the fibre pulp will assume the form of a suspension having the desired fibre concentration. However, there can be no certainty that the pulp suspension will be well homogenized, since no mechanical agitation is carried out.

It is also known to supply diluting liquid through nozzles over the surface of the fibre pulp at the top of the bleaching tower, but this does not solve the homogenization problem in a satisfactory manner, since liquid and fibre pulp do not have time to become mixed with each other and be well homogenized, before the scrapers drive the pulp out towards and over the overflow rim.

It is also known, from the diffuser technique, to supply washing liquid via nozzles to a diffuser at a substantial depth below the outfeed scrapers. An early example of this technique is described in SE 225 814. However, in this case, it is simply a question of supplying washing liquid which is taken up by the diffuser and conducted away through the latter, implying that no dilution of the fibre pulp which is being fed upwards through the cylindrical container takes place.

Another known diffuser technique is also to dilute pulp using diluting nozzles secured to a rotating arm, but the arm is then submerged in the pulp and is not provided with scraping blades.

BRIEF ACCOUNT OF THE INVENTION

The object of the invention is partly to facilitate the feeding-out of pulp over an overflow rim at the upper end of a cylindrical container, through which the pulp, which is suspended in a liquid, is being fed continuously from the bottom and upwards, preferably feeding-out of fibre pulp at the top of a bleaching tower, partly to dilute the pulp to a substantial degree, and partly to bring about an efficient homogenization of the fibre pulp and diluting liquid.

These and other objects can be achieved by the pulp being diluted at a level below the surface of the pulp through a multiplicity of nozzles, which are submerged in the pulp and which are rotated around the vertical centre line of the container, with so much diluting liquid that the quantity of liquid in the layer between the nozzles and the upper surface of the fibre pulp suspension is increased by at least 50%, preferably by at least 100%, and by the pulp, which has been fed upwards through the container, and the diluting liquid being thoroughly mixed with each other, to form an essentially homogeneous suspension, with the aid of rotating scrapers which are submerged in the outer layer of the suspension and, at the same time as they are homogenizing the mixture, convey the suspension outwards towards, and finally over, the overflow rim.

More specifically, the dilution takes place at such a depth below the surface of the pulp which is sufficiently great for the diluting liquid to have time, to the desired extent, to be mixed with the relatively concentrated fibre pulp, which is being fed up from below in the cylindrical container, before the fibre pulp and the diluting liquid reach the scrapers and are homogenized by the latter. At the same time, the rotating nozzles must not extend so deeply down into the pulp that they provide the whole of the pulp column in the cylindrical container with a tendency to rotate. Expediently, the diluting nozzles should be submerged to a depth in the fibre pulp which is chosen such that the median time of passage of the ascending fibre pulp suspension, and thus the mixing time of the diluting liquid, in the surface layer between nozzles and scrapers will amount to between 3 and 30 sec., preferably to between 5 and 20 sec. In other words, the depth of the diluting nozzles should be matched to the upwardly directed speed of movement of the fibre pulp column in the cylindrical container.

Expediently, the diluting liquid is sprayed out backwards through the nozzles in the tracks which the nozzles make, during their rotation, in the fibre pulp.

Expediently, the diluting nozzles are arranged on an arm above the container, expediently on the same arm on which the scrapers are mounted. The nozzles can, however, per se, conceivably be mounted on one of the arms of a cross, and the scrapers on the other arm of the same cross, with the point of intersection being at the centre of the container. This design can be utilized when the level of production is high, since the size of the diluting nozzles can result in it being difficult to find space for the scraping blades and diluting nozzles on the same arm.

As has been mentioned above, the depth of the nozzles in the fibre pulp is related to the upwardly directed speed of the fibre pulp in the container. Normally, however, the vertical distance between the lower edge of the scrapers and the lower edge of the nozzles amounts to between 100 and 500 mm, preferably to between 150 and 400 mm. According to a preferred embodiment, each nozzle is allocated a scraper, which is arranged at an angle inside the respective nozzle, seen in a radial direction. Means are preferably also arranged for regulating the flow of the diluting liquid to each nozzle.

As has been mentioned above, so much diluting liquid is added through the nozzles at a depth below the surface that the quantity of liquid in the surface layer increases by at least 50%, preferably by at least 100%, having the effect of facilitating the feeding-out over the overflow rim. In accordance with a conceivable variant of the invention, which exploits a technique which is known per se, additional diluting liquid is supplied to the pulp after the latter has been fed out over the rim, for example in the launder, so that the concentration is achieved which is desired for the subsequent transport and/or further treatment. Preferably, however, all the desired diluting liquid is added through the nozzles, signifying, according to the preferred process, at least a doubling of the liquid content or, to put it another way, at least a halving of the dry matter content in the suspension.

Additional features and aspects, and also advantages, of the invention are evident from the subsequent patent claims and from the following description of a preferred embodiment.

BRIEF DESCRIPTION OF THE FIGURES

In the following description of a preferred embodiment, reference will be made to the attached figure drawings, of which FIG. 1 constitutes a lateral view of the upper part of a bleaching tower, partially in cutaway, having a device according to the preferred embodiment of the invention.

DESCRIPTION OF PREFERRED EMBODIMENT

Figure 1:
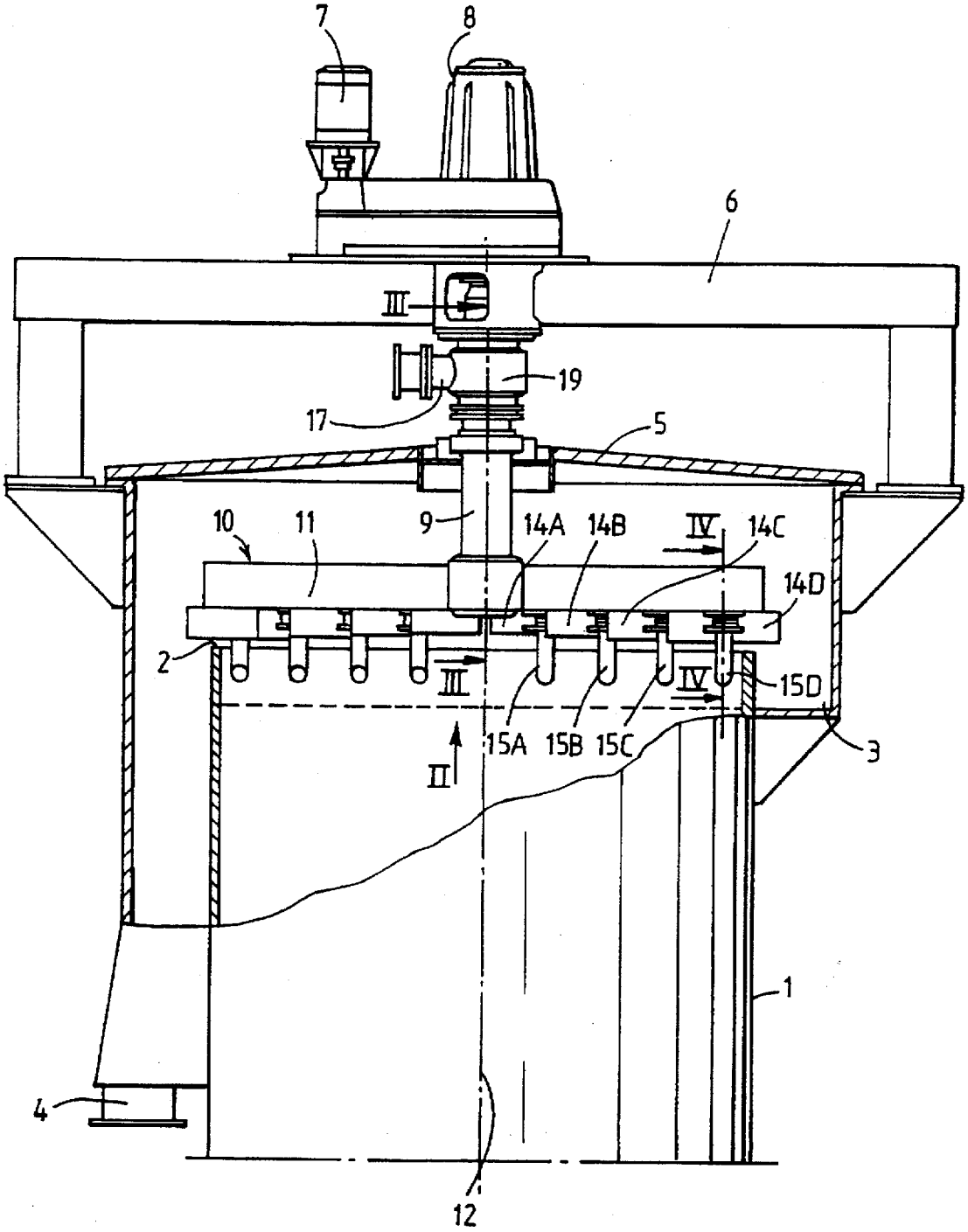

Referring first to FIG. 1, a bleaching tower for cellulose fibre pulp is designated generally by the numeral 1. This tower consists, in the conventional manner, of a circular/cylindrical container which is terminated at the top by an overflow rim 2. A collecting channel, a so-called launder 3, for pulp which is being fed out over the rim 2 extends, in the conventional manner, round the bleaching tower 1, below the overflow rim 2. The pulp is conducted away through a conduit 4. The bleaching tower 1 is covered by a roof 5, and above the roof 5 there is a platform 6 which supports a driving motor 7 and a driving gear 8 for a driving axle 9 which is arranged to rotate an outfeed scraper 10, having a scraper arm 11, around the vertical centre line 12 of the bleaching tower 1.

On the underside of the scraper arm 11, on each side of the centre line 12, there are located, on the one hand, a number of uniformly distributed scraper blades or elements 14A, 14B, 14C and 14D, and, on the other, an equally large number of diluting nozzles 15A, 15B, 15C and 15D, which extend downwards from the scraper arm 11 to a given level below the overflow rim 2 and thus to a given depth in the cellulose pulp which is being continuously fed up through the tower 1. The design of, and interaction between, the scraper blades 14A–D and the diluting nozzles 15A–D will be described in more detail below.

Figure 3:
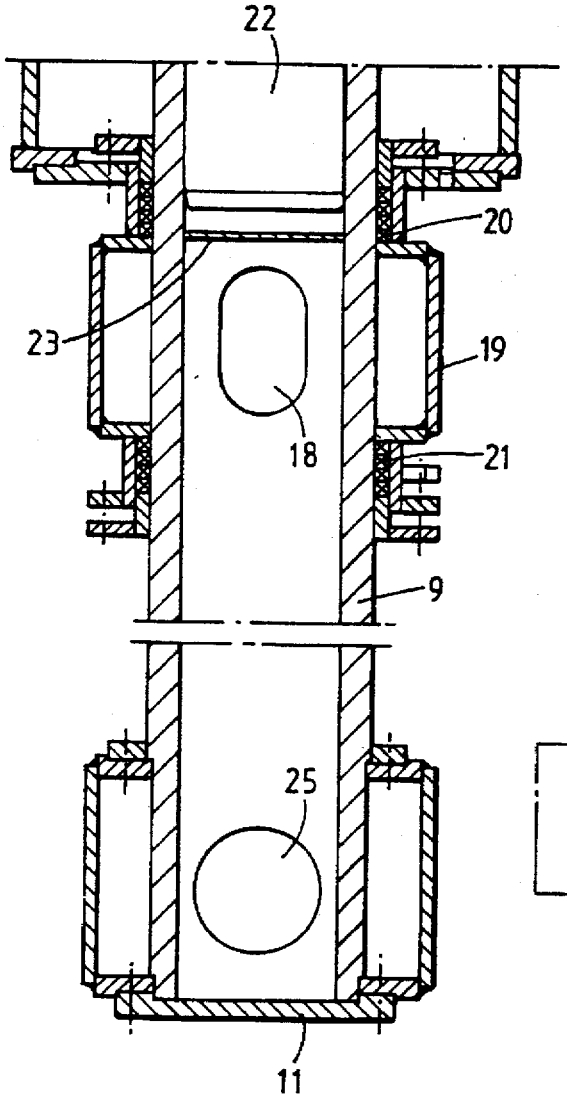
FIG. 3 shows a hollow axle, for rotating the said arm and for supplying diluting liquid, in a section III—III in FIG. 1.
Figure 4:
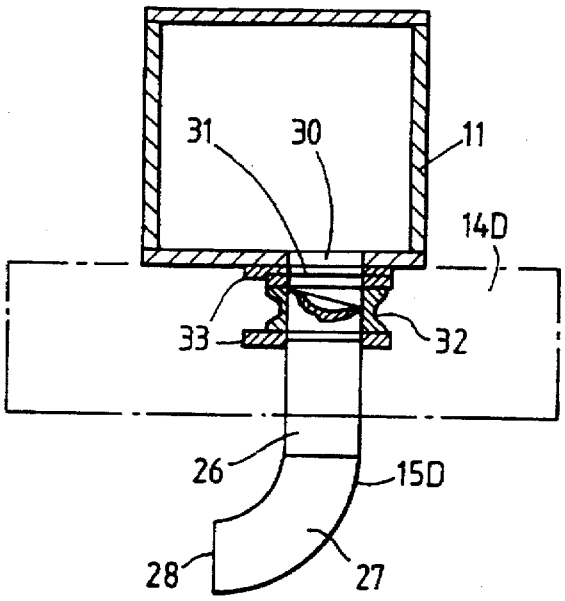
FIG. 4 shows the arm and a nozzle in a section IV—IV in FIG. 1.

The driving axle 9, FIG. 3, is, as has been mentioned above, designed as a hollow axle. The diluting liquid is conducted into the hollow axle 9 from a supply conduit 17 through a pair of inlet openings 18, which are arranged below the driving gear 8, via a rotor coupling 19 which is sealed off at the sides by means of gaskets 20, 21. An axle spindle 22 from the driving gear 8 extends downwards into the hollow axle 9, which is sealed off from the axle spindle 22 and from the driving gear 8 by means of a plate 23.

The scraper arm 11 is designed as a box girder. The hollow axle 9 communicates with the space inside the scraper arm 11 through a pair of openings 25.

Figure 2:
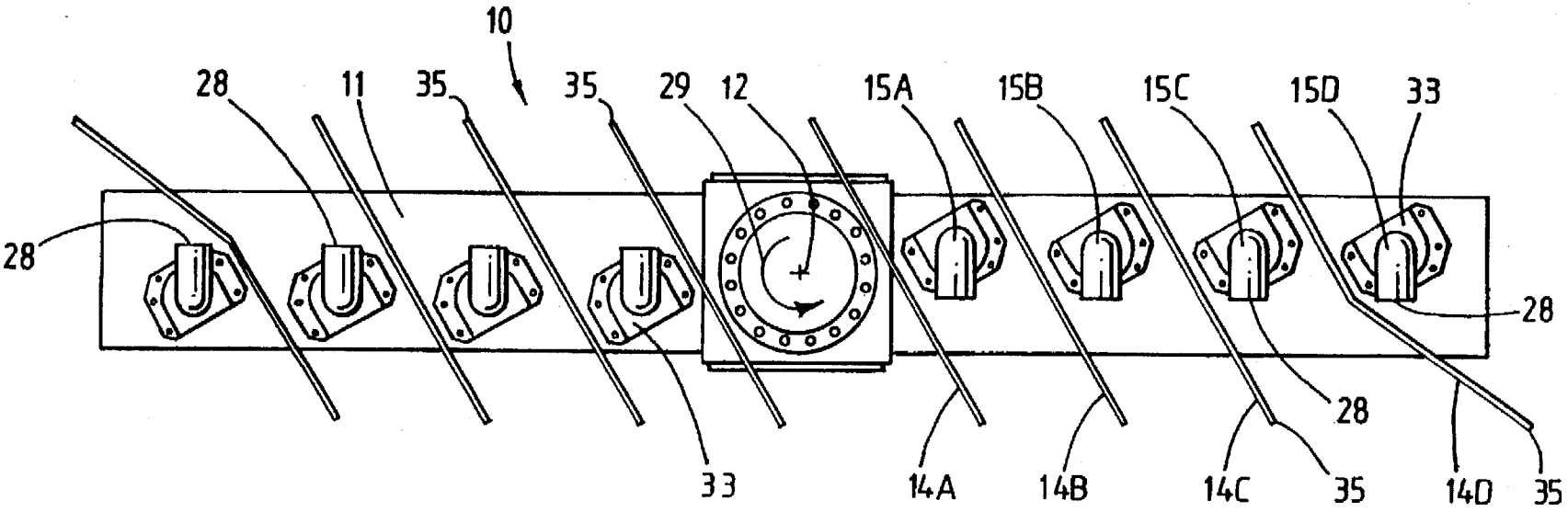
FIG. 2 shows a rotating arm with diluting nozzles and scrapers, viewed in the direction of the arrow II in FIG. 1.

The diluting nozzles, such as the diluting nozzle 15D, each consist of a vertical pipe section 26, which extends downwards from the underside of the scraper arm 11, and, at the lower end, of a curved outlet section 27 which is directed so that the outlet opening 28 faces in a direction which is perpendicular to the longitudinal direction of the scraper arm 11 and is opposite to the direction of rotation of the scraper arm. The direction is also evident from FIG. 2, in which the arrow 29 shows the direction of rotation of the scraper 10. In a specific case, which is not delimiting for the principles of the invention, the total distance from the underside of the scraper arm 11 to the lower edge of the diluting nozzle 15D, i.e. the lower edge of the outlet opening 28, was approximately 500 mm, and the distance from the lower edge of the scraper blade 14D to the said lower edge of the diluting nozzle 15D was approximately 250 mm.

The diluting nozzles, such as the diluting nozzle 15D, are each connected to an outlet opening 30 in the underside of the scraper arm 11 via a constricting plate 31, which regulates the flow through the nozzle 15D, and a non-return valve 32, which prevents the fibre pulp from penetrating up through the opening 30. A pair of mounting plates have been designated 33. In a specific case, which is shown in the drawings, the scraper arm 11 had a length of 3,600 mm, corresponding approximately to the diameter of the bleaching tower 1. The distance between each of the four diluting nozzles 15A–D on each half of the scraper arm 11 was identical and amounted to 385 mm. The scraper blades 14A–D are arranged at the same distance from each other along the length of the scraper arm 11 and are placed at an angle, in a manner known per se, in order to be able to impel the upwardly flowing pulp suspension out towards and over the overflow rim 2. More specifically, the scraper blades 14A–D are so arranged that each diluting nozzle has a scraper blade, allocated for this diluting nozzle, arranged inside it, seen in a radial direction, with the scraper blade extending obliquely backwards/outwards so that the lagging end 35 of the scraper blade is located behind that diluting nozzle to which this scraper blade is allocated. For example, the lagging end 35 of the scraper blade 14A is located behind the nozzle 15A, with "behind" being understood to mean that the end comes after the nozzle during rotation of the scraper 10 in the direction of the arrow 29, i.e. in the "wake" of the nozzle, so that the scraper blade will exert its effect in this "wake", and homogenize the mixture, when the suspension, after a period of the order of size of 10 sec—in a continuous progress—reaches the scraper blade.

The described device functions in the following manner. The cellulose fibre pulp is fed continuously in the direction from below and upwards in the bleaching tower 1. The concentration is 8–12% dry matter content, or approximately 10%. The remainder, i.e. approximately 90%, consists of liquid, mainly water. The outfeed scraper 10 is rotated around the centre of rotation 12 with the aid of the motor 7 via the driving gear 8 and the hollow axle 9 with a speed of rotation of about 4 revolutions/min. Diluting water is conducted, through the eight diluting nozzles 14A–D which are rotating in the fibre pulp, into the pulp in a horizontal direction, backwards in the tracks which the diluting nozzles are making in the medium-thick pulp during their rotation around the centre line 12. The diluting liquid is, as it were, injected out into the tracks which are formed behind the rotating nozzles. The flow is regulated by means of the constricting plates 31, so that the quantity of diluting liquid for the fibre pulp is matched to that cross-section of the pulp bed which each rotating diluting nozzle is to dilute. In accordance with the preferred embodiment, the dilution is so extensive that the quantity of liquid is at least doubled in the suspension which is being fed further upwards. More specifically, a dilution takes place from 8–12% to 3–5% dry matter content, preferably to approximately 4% dry matter content.

The extensive dilution also gives rise to a corresponding increase in volume, implying that the speed at which the fibre pulp column is being fed in an upward direction increases to a corresponding degree in the layer adjacent to and above the diluting nozzles 15A–D. Taking into consideration, on the one hand, the general speed at which the fibre pulp is being fed up through the bleaching tower 1, and, on the other, the increase in speed of feeding resulting from the dilution, the diluting nozzles 15A–D are arranged at such a depth that the median passage time of the ascending fibre pulp suspension, and thus the mixing-in time of the diluting liquid, in the surface layer between the diluting nozzles 15A–D and the scraper blades 14A–D amounts to approximately 10 sec. Under the specific conditions which have been described above, the time has been calculated to be 10.6 sec. The passage time between the diluting nozzles 15A–D and the overflow rim 2 amounts to approximately 7 sec. (more precisely 7.3 sec. in calculations which have been made). During this time, and due to the relatively dense distribution of the diluting nozzles over the diameter of the bleaching tower 1, and also by means of the directing of the feeding-out openings of the nozzles, it becomes possible to get the intended quantity of diluting liquid into a very limited space, namely the space between the nozzles and the scraper blades, in a very limited period of time. In this context, the term "get into" also includes an initial mixing, or at least a mainly uniform distribution, of the diluting liquid over the horizontal cross-section of the pulp column.

Since the diluting liquid streams out backwards through the outlet openings 28 at relatively great speed and force, it also has a certain ejector effect on the fibre pulp. Since the outlet openings 28 are directed backwards relative to the direction of rotation of the outfeed scraper 10, this ejector effect can counteract any tendency of the fibre pulp in the bleaching tower 1 to rotate around the centre line 12, which tendency could possibly result from the rotation of the diluting nozzles 15A–D in the bleaching tower.

The amalgamation of the fibre pulp and the diluting liquid to form an attenuated, homogeneous suspension is completed by the scraper blades 14A–D. The homogenization and the attenuation of the suspension also facilitate a more uniform feeding-out of the suspension over the overflow rim 2 to the launder 3, whence the pulp, which now—in accordance with the embodiment—has a dry matter content of approximately 4%, can be fed onwards through the conduit 4 for subsequent treatment.

We claim:

1. A method for dispersing fiber pulp over an overflow rim disposed at an upper end of a cylindrical container having a longitudinal axis and a bottom, the container containing a suspension, comprising the steps of:

providing a scraper element in rotatable engagement with the container;

providing a plurality of rotatable diluting nozzles attached to the scraper element, the diluting nozzles being rotatable about the longitudinal axis of the container;

continuously feeding fiber pulp from the bottom of the container and upwardly through the container;

suspending the fiber pulp in the suspension contained in the cylindrical container to form a fiber pulp suspension, the fiber pulp suspension having an upper surface;

diluting the fiber pulp suspension at a level that is below the upper surface of the fiber pulp suspension by discharging a liquid through the diluting nozzles, the diluting nozzles extending downwardly through the upper surface;

mixing the fiber pulp suspension and the liquid to form a substantially homogenous diluted suspension by rotating the scraper element, the scraper element extending downwardly into the diluted suspension; and while forming the homogenous diluted suspension, permitting the homogenous diluted suspension to flow outwardly and over the overflow rim.

2. The method according to claim 1 wherein the fiber pulp suspension and liquid disposed between the diluting nozzles and the upper surface form a volume and the step of diluting the fiber pulp suspension includes adding liquid to increase the volume formed between the diluting nozzles and the upper surface by at least 50%.

3. The method according to claim 1 wherein the fiber pulp suspension and liquid disposed between the diluting nozzles and the upper surface form a volume and the step of diluting the fiber pulp suspension includes adding liquid to increase the volume formed between the diluting nozzles and the upper surface by at least 100%.

4. The method according to claim 1 wherein the dilution step includes the step of spraying liquid through the diluting nozzles in an backward direction relative to the rotational movement of the scraper element about the longitudinal axis of the container.

5. The method according to claim 1 wherein the fiber pulp suspension and the liquid are thoroughly mixed for a time period ranging from between about three seconds and about thirty seconds to form a substantially homogenous suspension disposed between the diluting nozzles and the upper surface.

6. The method according to claim 5 wherein the time period ranges from between about five seconds to about twenty seconds.

7. A method for dispersing fiber pulp over an overflow rim disposed at an upper end of a cylindrical container having a longitudinal axis and a bottom, the container containing a suspension, comprising the steps of:

providing a scraper element in rotatable engagement with the container;

providing a plurality of rotatable diluting nozzles attached to the scraper element, the diluting nozzles being rotatable about the longitudinal axis of the container;

continuously feeding fiber pulp from the bottom of the container and upwardly through the container;

suspending the fiber pulp in the suspension contained in the cylindrical container to form a fiber pulp suspension, the fiber pulp suspension having an upper surface;

diluting the fiber pulp suspension at a level that is below the upper surface of the fiber pulp suspension by spraying a liquid through the diluting nozzles in an backward direction relative to the rotational movement of the scraper element about the longitudinal axis of the container and adding liquid to increase a volume formed between the diluting nozzles and the upper surface by at least 50%, the diluting nozzles extending downwardly through the upper surface;

mixing the fiber pulp suspension and the liquid for a time period ranging from between about three seconds and about thirty seconds to form a substantially homogenous diluted suspension by rotating the scraper element, the scraper element extending downwardly into the diluted suspension; and while forming the homogenous diluted suspension, permitting the homogenous diluted suspension to flow outwardly and over the overflow rim.

8. A pulp feeding device, comprising:

a cylindrical container having a longitudinal axis and an upper end, the container containing a fiber pulp suspension having a surface layer;

an overflow rim disposed at the upper end of the container, the fiber pulp suspension being permitted to continuously flow upwardly through the cylindrical container to flow outwardly over the overflow rim;

a scraper arm positioned above the cylindrical container;

a plurality of diluting nozzles in operative engagement with the scraper arm, the diluting nozzles extending downwardly into the fiber pulp suspension to substantially dilute the suspension with a liquid, each diluting nozzle having outlet openings defined therein;

a driving member rotating the scraper arm and the diluting nozzles about the longitudinal axis of the container;

a plurality of scraper elements disposed above the container and in operative engagement with the scraper arm, the scraper elements being rotatable about the longitudinal axis at the surface layer of the fiber pulp suspension to thoroughly mix the liquid and the fiber pulp suspension to form a homogenized mixture, the scraper elements directing the homogenized mixture radially outwardly to permit the homogenized mixture to flow over the overflow rim, each scraper element having a lagging end portion, the lagging end portions extending obliquely across the outlet openings of the diluting nozzles.

9. The pulp feeding device according to claim 8 wherein the scraper elements have a lower edge and the diluting nozzles have a lower edge so that a distance is formed between the lower edge of the scraper elements and the lower edge of the diluting nozzles, the distance is between about 100 millimeters and about 500 millimeters.

10. The pulp feeding device according to claim 9 wherein the distance is between about 150 millimeters and about 400 millimeters.

11. The pulp feeding device according to claim 8 wherein the outlet openings face a horizontal backward direction relative to a path formed by the diluting nozzles when the nozzles are rotated about the longitudinal axis.

12. The pulp feeding device according to claim 8 wherein the scraper elements are in operative engagement with the diluting nozzles, the scraper elements are disposed radially behind the diluting nozzles at a sloping angle relative to a rotational movement of the diluting nozzles when the diluting nozzles are rotated about the longitudinal axis.

13. The pulp feeding device according to claim 8 wherein the diluting nozzles and the scraper elements are in operative engagement with the same scraper arm.

14. The pulp feeding device according to claim 8 wherein the device further comprises a hollow axle attached to the scraper arm, driving elements operatively attached to the hollow axle and adapted to rotate the hollow axle, the scraper arm is a tube-shaped arm that diametrically extends above the container, the hollow axle has an inlet defined therein for receiving diluting liquid, the hollow axle is in fluid communication with the scraper arm and the diluting nozzle so that diluting liquid is permitted to flow from the hollow axle out through the diluting nozzle.

15. The pulp feeding device according to claim 14 wherein the devices further comprises a member attached to the diluting nozzle for controlling the flow of diluting liquid to each of the individual diluting nozzles.

16. The pulp feeding device according to claim 14 wherein the diluting liquid is permitted to flow into inlet openings of the hollow axle and the hollow axle rotating the diluting nozzles, the devices further comprises a power transmission gear disposed above the inlet openings and the power transmission gear is adapted to the rotate the hollow axle and the scraper arm, the diluting liquid is permitted to flow from the hollow axle through the scraper arm and to the diluting nozzles.

17. A pulp feeding device, comprising:

a cylindrical container having a longitudinal axis and an upper end, the container containing a fiber pulp suspension having a surface layer;

an overflow rim disposed at the upper end of the container, the fiber pulp suspension being permitted to continuously flow upwardly through the cylindrical container to flow over the overflow rim;

a scraper arm positioned above the cylindrical container, the scraper arm being rotatable about the longitudinal axis of the container, the scraper arm having a lower edge, the scraper arm being tube-shaped and extending diametrically above the container;

a hollow axle attached to the scraper arm, the hollow axle having an inlet opening defined therein for receiving diluting liquid, the hollow axle being in fluid communication with the scraper arm so that diluting fluid is permitted to flow from the hollow axle into the scraper arm;

driving elements operatively attached to the hollow axle to rotate the hollow axle;

a plurality of diluting nozzles in operative engagement with the scraper arm, the diluting nozzles extending downwardly into the fiber pulp suspension to substantially dilute the suspension with a liquid, the diluting nozzles having a lower edge so that a distance is formed between the lower edge of the scraper elements and the lower edge of the diluting nozzles, the distance is between about 150 millimeters and about 400 millimeters, the diluting nozzles being in fluid communication with the scraper arm so that diluting liquid is permitted to flow from the scraper arm out through the diluting nozzles;

the diluting nozzles having outlet openings formed therein, the outlet openings facing away from a radial rotational direction of a rotational movement of the diluting nozzles when the diluting nozzles are rotated about the longitudinal axis of the container;

flow controlling means for controlling the flow of diluting liquid from the scraper arm to the diluting nozzles, said flow controlling means disposed in the diluting nozzles; and a plurality of scraper elements in operative engagement with the scraper arm, the scraper elements rotatable about the longitudinal axis at the surface layer of the fiber pulp suspension to thoroughly mix the liquid and the fiber pulp suspension to form a homogenized mixture, the scraper elements directing the mixture radially outwardly to permit the mixture to flow over the overflow rim, the scraper elements being in operative engagement with the diluting nozzles and disposed radially behind the diluting nozzles at a sloping angle relative to a rotational movement of the diluting nozzles when the diluting nozzles are rotated about the longitudinal axis, each scraper element having a lagging portion, the lagging portions extending obliquely across the openings of the diluting nozzles.

* * * * *